United States Patent [19]

Brodmann

[11] Patent Number: 4,722,735

[45] Date of Patent: Feb. 2, 1988

[54] CONTINUOUS DYEING PROCESSING FOR TEXTILES

[75] Inventor: George L. Brodmann, Greensboro, N.C.

[73] Assignee: Burlington Industries, Inc., Greensboro, N.C.

[21] Appl. No.: 1,748

[22] Filed: Jan. 9, 1987

[51] Int. Cl.[4] ..... D06P 5/04

[52] U.S. Cl. ..... 8/492; 8/503; 8/924; 8/917; 8/681

[58] Field of Search ..... 8/492, 503

[56] References Cited

U.S. PATENT DOCUMENTS 4,055,971 11/1977 Hermes ..... 68/9

FOREIGN PATENT DOCUMENTS 1404595 9/1975 United Kingdom .

*Primary Examiner*—A. Lionel Clingman
*Assistant Examiner*—Isabelle Rodriguez
*Attorney, Agent, or Firm*—Nixon & Vanderhye

[57] ABSTRACT

A process is described for the continuous dyeing of textiles in which an aqueous solution of an ionic, water-soluble dye is applied to a fabric in open width. The textile is dried to reduce the water content to at most about 1% and it is then contacted with a nonionic, high-boiling organic liquid in which the ionic dye is substantially completely insoluble while the liquid is maintained at an elevated temperature, i.e., about 325° F.–450° F., for a period of time sufficient to cause the dye to diffuse into the fibers and to fix the ionic dye to the fibers of the textile. Any remainig high-boiling liquid is subsequently removed from the fabric.

23 Claims, No Drawings

CONTINUOUS DYEING PROCESSING FOR TEXTILES

BACKGROUND OF THE INVENTION

This invention relates to a process for the continuous dyeing of textiles. More particularly, the invention includes a process for the rapid, continuous dyeing of synthetic polyamide and wool fabrics in open width using selected, water-soluble commercial anionic dyes and a high-boiling, nonionic organic solvent medium to provide the energy for rapid dye diffusion into the fibers.

There is a class of waterless dye compositions used to dye textiles and other solid polymeric articles in which a dyestuff is dissolved or dispersed in a high-boiling, nonionic organic medium. The article to be dyed is immersed in or otherwise contacted with the dyeing composition and the article is colored while the dye composition is maintained at elevated temperature. Of the commercially-available range of dyestuffs, very few are soluble or even suitable for use in connection with high-boiling, nonionic organic media. In practice, the use of such media is limited to crude disperse and solvent dyes. As a practical matter, ionic dyes, such as acid, cationic and fiber-reactive dyes, those dyes traditionally applied to a textile via an aqueous medium, cannot be successfully used to dye nylon, wool or cellulosic fabrics in high-boiling, nonionic organic media, because ionic dyes are insoluble in such media.

Another well-known and documented type of dyeing procedure is that of thermosoling. In this dyeing procedure, an aqueous dyestuff solution is applied to the textile, the amount of moisture or wet pick-up is adjusted and the impregnated textile is then subjected to or dry heat in order to fix the dye to the textile fibers; this is often referred to in the art as thermosoling. In this manner, the dye is diffused into the fiber by the dry heat. The dye can also be fixed by steaming.

SUMMARY OF THE INVENTION

I have discovered a procedure in which textile materials, particularly synthetic polyamides and wools, may be dyed in a rapid, continuous process in open width using selected, commercially-available ionic dyes that are soluble in water, yet substantially completely insoluble in the liquid medium used to fix the dye to the fibers. In this process a high-boiling, nonionic organic medium is maintained at an elevated temperature and is used to diffuse the dyes into the fabric while the fibers are in a swollen condition, yet the water-soluble dyestuff, being insoluble in the organic medium, remains with the fiber and does not dissolve in or otherwise contaminate the medium employed.

Unlike conventional uses of nonionic, high-boiling organic liquids used in dyeing procedures in which the dye is dispersed or dissolved in the liquid, the process of the present invention uses the high-boiling, organic liquid medium as a means to diffuse and fix the previously applied dye, insoluble in the organic liquid medium itself, into the fibers to be dyed. Because no dyes or tinctorial agents are added to the high-boiling organic liquid, it remains substantially colorless and the liquid may be conveniently reused even with dyes of a different color without the need for activated carbon adsorbers or other devices to decolorize the liquid as are required in conventional dyeing procedures.

The process of this invention includes preparing an aqueous solution of one or more water-soluble ionic dyes and applying that solution, typically in the form of a textile pad bath, to the textile product to be colored. The amount of aqueous dye solution taken up by the fabric, termed wet pick-up, varies depending upon the fiber content, type of fabric, the dye penetrant, pH, bath temperature, immersion time and squeezing pressure applied to the fabric, as well as other factors. Conveniently, the amount of wet pick-up is adjusted by means of a pair of squeeze rollers, the pressure on which can be varied. Preferably, the wet pick-up will be in the range of 40 to about 100%. Once impregnated and adjusted as to wet pick-up, the fabric is dried using any suitable drying means such as an infrared dryer or a forced hot air oven. The drying step desirably reduces the moisture in the fabric to an amount in the range of from 0 to about 1%. As an example, a forced hot air oven, maintained at a working temperature of about 180°-200° F., provides a reduction in the fabric moisture to from 0 to up to 1% after exposure in such an oven a period of from 1 to 5 minutes, depending, of course, upon other factors as mentioned above. As demonstrated below, this drying step is critical to achieve adequate color values with a minimum of streaks and barré.

As an alternative to the padding operation, other methods of application may be used. A particularly effective means is by a fluid jet machine, which permits the application of dye in either a print pattern or a solid shade with a minimum of added water. Only a brief drying is then necessary to reduce the moisture content below about 1%.

Once the moisture level is reduced, the dry fabrics are immersed in a high-boiling, nonionic organic liquid bath in which the ionic dyes used to dye the fabric are insoluble. Immersion time in the organic liquid may range from a period of from 10 to about 60 seconds when the organic liquid is maintained at a temperature in the range of about 350° to 39020 F. for dyeing synthetic polyamides and about 325° to 340° F. for dyeing wools. It will be appreciated that the exact temperature and time the fabric is exposed to the high-boiling liquid can be determined by the skilled operator through a series of experiments and comparisons. Because the dyes used in this process insoluble in the high-boiling organic medium, the dye is rapidly diffused into the fibers which are swollen by the heat and the small amount of moisture, if any, remaining in the fiber. The dyeing process is characterized by the lack of coloration or tint imparted to the high-boiling organic medium at the conclusion of the fixation process. This facilitates reuse of the high-boiling, organic medium, a relatively expensive material particularly with dyes of different shades.

Once the dye is fixed, the fabric is then treated to remove any residual high-boiling solvent medium and any unfixed dye that may remain on the surface of the fibers. Suitable solvents for removing the high-boiling organic medium include chlorinated or fluorinated hydrocarbons, as well as the more volatile, lower-boiling organic solvents such as acetone. Products so dyed exhibit good color yield and colorfastness with at least a fair to good dye penetration level. The dye penetration may be further enhanced by the use of effective ionic wetting and swelling agents added to the dye pad liquid, provided that these agents are insoluble in the high-boiling solvent medium.

Dyestuffs suitable for the process of this invention are those that are soluble in aqueous media yet insoluble in the high-boiling nonionic organic media used to fix the dyestuff to the fibers. Candidate dyestuffs generally will fall into the category of anionic, cationic or fiber-reactive dyes, with the anionics being preferred, and monosulfonic anionic dyes especially preferred.

Of the fiber-reactive dyes, the Kayacelon reactive dyes, of which the reactive group is 3-carboxypyridinio 1-,3-,5-triazine, are preferred. This class of dyes does not require the use of acids, alkalies, wetting agents, or other additives in the pad bath, which after the drying operation will be removed by the high-boiling nonionic medium. Such contamination of the high-boiling medium can lead to subsequent bleeding of dye into the medium in continued use.

Fabrics amenable to the continuous dyeing process of this invention are readily determined by assessing the processing conditions, including elevated dye fixation temperatures, compared with the physical characteristics of the fibers constituting the fabrics. This process is suited to the continuous dyeing of polyamides (such as nylons and wool), polyacrylics, cotton and rayon, as well as those polyesters that accept cationic dyeing. Nylon, especially high-tenacity nylon, and wools are particularly suited to the process of this invention.

The high-boiling liquids used in the process of this invention are described in the patent literature and elsewhere as vehicles or solvents for dyestuffs used to form waterless dyeing compositions. See, for example, U.S. Pat. No. 4,055,971 to Hermes describing the use of glycols or glycol ethers as high-boiling liquids for waterless dyeing and heat setting of textiles as well as the aromatic esters and cycloaliphatic diesters disclosed in U.S. Pat. No. 4,293,305 to Wilson.

The preferred aromatic esters can be of the formula $ArCOOR_2$, $ArCOO\text{-}R_1\text{—}OOCAr$ or $(ArCOO)_2\text{—}R_3$, wherein $R_1$ is alkylene of 2–8 carbon atoms or polyoxyalkylene of the formula $\text{—}C_rH_{2r})(OC_rH_{2r})_s$, in which r is 2 or 3 and s is up to 15; $R_2$ is substituted or unsubstituted alkyl or alkenyl of 8–30 atoms; $R_3$ is the residue of a polyhydric alcohol having z hydroxyl groups; Ar is mono- or bicyclic aryl of up to 15 carbon atoms and z is 3–6.

Furthermore, the cycloaliphatic ester can be of the formula:

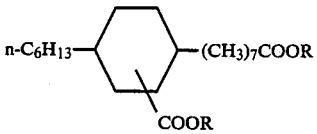

where R is substituted or unsubstituted straight or branched chain alkyl of 4–20 carbon atoms, polyoxyalkylene of the formula $R'(OC_xH_{2x})_n$ or phosphated polyoxyalkylene of the formula:

$$(HO)_2P(=O)(OC_xH_{2x})_nOC_xOC_xH_{2x})$$

or a salt thereof, wherein $(OC_xH_{2x}O)_n$ is $(C_2H_4O)_n$—,$(C_3H_6O)_n$— or $(C_2H_4O)p$—, or $(C_3H_6O)q$—; $R^1$ is H or ArCO; Ar is mono- or bicyclic aryl of up to 15 carbon atoms; x is 2 or 3; n is 2–22 and the sum of p+q is n.

The preferred high-boiling, nonionic organic solvents include triesters of 1,2,4-benzenetricarboxylic acid, also known as trimellitic acid. Preferred esters are tris(2-ethyhexyl)trimellitate, trisisodecyl trimellitate, trisisooctyl trimellitate, tridecyl trimellitate, and trihexadecyl trimellitate. It will be understood that mixed esters such as hexyl, octyl, decyl trimellitate can also be used. Most preferred is tris(2-ethylhexyl)trimellitate (CAS No. 3319-31-1), also known as trioctyl trimellitate, which can be purchased from Eastman Chemical Products, Inc., Kingsport, Tennessee, as Kodaflex® TOTM.

Other solvents suitable for the high-boiling liquids used in the process of this invention include, among others, those described in U.S. Pat. No. 4,293,305; 4,394,126; 4,426,297; and 4,581,035.

A critical aspect of the present invention is that the fabric following treatment with the aqueous dye composition must be dried or substantially completely dried before final heat treatment with the high-boiling solvent. As demonstrated in the examples that follow, immersion of "wet" fabric still containing considerable quantities of the aqueous dye solution into a hot, high-boiling liquid causes severe dye bleeding in the organic liquid which contaminates the liquid and poor dye penetration into the fiber.

The invention will now be explained with reference to the following examples in which all parts and percentages are reported by weight and all temperatures in degrees Fahrenheit unless otherwise indicated. Colorfastness tests were performed according to standard methods of the American Association of Textile Chemists and Colorists, as described in the 1985 Technical Manual of that organization:

| Test | Method No. |
|---|---|
| Colorfastness to Crocking | 8-1981 |
| Colorfastness to Light | 16A-1982 |
| Colorfastness to Washing | 61-1980 |

The rating scale for all of these tests goes from 5 (negligible or no change in color) to 1 (severe change in color).

EXAMPLE I

High-tenacity nylon 66 and wool fabrics, respectively, were padded with the following dye solutions:

| | |
|---|---|
| A. 10 g/liter | Acid Orange 156 |
| B. 10 g/liter | Acid Red 361 |
| C. 10 g/liter | Acid Blue 377 |

Both fabrics were padded at 140° for one second with the three different dye solutions. Wet pick-ups were 20% for nylon 66 and 40% for wool. After wet padding, each fabric was cut in half. One half was left wet, and the other half was dried to 0–1% moisture content.

The fabrics, in separate beakers, were then immersed in tris(2-ethylhexyl)trimellitate as follows:

Nylon 66 fabric at 350° F. for 30 seconds

Wool fabric at 335° F. for 30 seconds

To remove high-boiling medium and dye, the fabrics were immersed for 5 seconds in perchlorethylene maintained at 120° F. Two rinse baths were then used to completely remove excess color.

The results of colorfastness tests on the predried, dyed fabrics are shown in Table I. As indicated by these data, the fastness properties of the dyed high-tenacity nylon were excellent, and those for the dyed wool fabric were quite acceptable.

It was noted that the water-wet fabric samples which had not been predried heavily discolored the tris(2-ethylhexyl)trimellitate liquid, while the predried fabrics lost very little color to the liquid.

TABLE I

Colorfastness of Dyed Fabrics

| Dye | Fabric | Lightfastness (20 hours) | Colorfastness Results: Crocking Dry | Crocking Wet | IIA Wash |
|---|---|---|---|---|---|
| Acid | Nylon 66 | 4.5 | 5.0 | 4.0 | 3.5 |
| Orange 165 | Wool | 3.5 | 4.0 | 3.5 | 3.0 |
| Acid Red 361 | Nylon 66 | 4.0 | 5.0 | 4.0 | 3.5 |
| | Wool | 3.0 | 4.0 | 3.5 | 3.0 |
| Acid Blue 277 | Nylon 66 | 4.0 | 5.0 | 4.0 | 3.5 |
| | Wool | 3.5 | 5.0 | 3.5 | 3.0 |

EXAMPLE II

Cordura® 440 high-tenacity nylon 6,6 fabrics were padded with the following dye solutions at pH 3.5 to obtain an olive green shade:

| | |
|---|---|
| 19 g/liter | Acid Orange 156 |
| 1 g/liter | Acid Red 361 |
| 20 g/liter | Acid Blue 277 |
| 2 g/liter | wetting agent |

Padding was performed at 175° F.±2° F. for one second of immersion and the wet pick-up was 60%. One half of the fabric was dried at 180° F. for 5 minutes to a moisture content of 0.75%. The other half the fabric was not dried.

The two fabrics were then immersed separately in tris(2-ethylhexyl)trimellitate (1:100 fabric-to-liquid ratio) for 30 seconds at a bath temperature of 390° F. Rapid dye fixation was obtained on the predried fabric to a deep olive green shade. The tris(2-ethylhexyl)-trimellitate remained uncolored, since the dyes are insoluble in the moisture-free medium. In contrast, the wet (non-predried) fabric bled copiously into the hot medium. To remove the high-boiling medium and excess surface dyes, the fabrics were scoured by first rinsing for 15 seconds in acetone. Three fresh acetone baths were used to remove all excess dyes.

The results of penetration and fastness tests on the dyed Cordura® fabric are presented in Table II. As can be seen from these results, the predried fabric had significantly better dye penetration, lightfastness, resistance to crocking and fastness to laundering than did non-predried fabric. The advantages of predrying are quite evident from these results.

TABLE II

Penetration and Fastness Tests on Dyed Cordura®

| Dye Fixation Method | Dry Penetration | Colorfastness (AATCC): Light | Crocking Wet | Crocking Dry | IIA Wash |
|---|---|---|---|---|---|
| Predried, then fixed for 30 sec. at 390° F. | Good | 4.5 | 5 | 4 | 3.5 |
| Wet (not predried), fixed for 30 sec. at 390° F. | Poor | 3.5 | 4 | 3 | 2.5 |

EXAMPLE III

Acrylic (Orlon copolymer), cationic dyeable polyester (Dacron T-64) and Nomex T-455 were padded with the following cationic dye solutions:

| | |
|---|---|
| A. 10 g/liter | Astrazon Yellow 7GL (Basic Yellow 21) |
| B. 10 g/liter | Astrazon Red BBL (Basic Red 23) |
| C. 10 g/liter | Basacryl Blue GL (Basic Blue 54) |

All three fabrics were padded with the three different solutions of cationic dyes. Wet pick-ups were approximately 50% by weight. After padding, each fabric was dried to 0.5–1% moisture content.

The fabrics, in separate beakers, were then immersed in tris(2-ethylhexyl)trimellitate at 350° F. for 30 seconds. The high-boiling medium and dye were then removed by immersing the fabric in perchlorethylene at 120° F. Rinsing was continued until no more dye bleeding was noticed.

The results of evaluation of the dyed samples are presented in Table III. The data show that the dye yield (as judged by depth of color) was excellent for Orlon, good for cationic-dyeable polyester (Dacron T-64), and only fair for Nomex T-455. These results are paralleled by the colorfastness data; fastnesses were best for Orlon, intermediate for Dacron T-64, and lowest for the Nomex T-455. The lightfastness of Orlon with all three cationic dyes was significantly better than that for the Dacron T-64 or especially the Nomex T-455.

Taken as a whole, the results in Table III demonstrate that the process of this invention is effective for the application of cationic dyes.

TABLE III

Fastness Properties of Fabrics Dyed With Cationic Dyes

| Dyestuff | Fabric | Dye Yield | Colorfastness: Light Rating/hrs.* | Crocking Wet | Crocking Dry | AATCC IIA Wash |
|---|---|---|---|---|---|---|
| Astrazon | Orlon | Excellent | 5.0/80 | 4.0 | 4.5 | 5.0 |
| Yellow 7GL | Dacron T-64 | Good | 4.0/60 | 4.0 | 4.5 | 5.0 |
| | Nomex T-455 | Fair | 1.0/20 | 3.0 | 3.0 | 4.0 |
| Astrazon | Orlon | Excellent | 4.5/80 | 4.0 | 4.5 | 5.0 |
| Red BBL | Dacron T-64 | Good | 3.0/20 | 4.0 | 4.5 | 5.0 |
| | Nomex T-455 | Fair | 1.0/20 | 2.5 | 3.0 | 3.0 |
| Basacryl | Orlon | Excellent | 4.5/80 | 3.5 | 3.5 | 5.0 |
| Blue GL | Dacron T-64 | Good | 4.0/20 | 4.0 | 3.5 | 5.0 |
| | Nomex T-455 | Fair | 1.0/20 | 2.0 | 2.5 | 3.0 |

*AATCC rating/hours of exposure.

What is claimed:

1. A process for continuously dyeing a textile selected from the group consisting of synthetic polyamide, aramid, wool, acrylic, cationic-dyeable polyester, cotton or blends thereof in open width with an ionic dye, comprising the steps of:

(a) applying an aqueous solution of at least one ionic, water-soluble dye to a textile in open width;

(b) drying the textile of step (a) to reduce the water content to at most about 1%;

(c) contacting the dried textile of step (b) with a nonionic, high-boiling organic liquid medium in which the ionic dye is substantially completely insoluble while the media is maintained at an elevated temperature for a period of time sufficient to cause the dye to diffuse into the fibers and to fix the ionic dye to the fibers of the textile; and thereafter (d) removing any high-boiling liquid medium, unfixed dye or both remaining on the fabric.

2. The dyeing process of claim 1, in which the wet pick-up of the textile is adjusted to at most 50% by weight prior to drying step (b).

3. The dyeing process of claim 1, in which the high-boiling organic liquid medium is maintained at a temperature in the range of about 325° F. to about 450° F.

4. The dyeing process of claim 3, in which the high-boiling organic liquid medium is maintained at a temperature in the range of about 325° F. to about 390° F.

5. The dyeing process of claim 3, in which the textile is contacted with the nonionic, high-boiling organic liquid medium for a period of from 10 seconds to about 120 seconds.

6. The dyeing process of claim 5, in which the textile is contacted with the nonionic, high-boiling organic liquid medium for a period of from 20 seconds up to about 60 seconds.

7. The dyeing process of claim 1, in which the nonionic, high-boiling organic liquid medium is substantially colorless at the completion of step (c).

8. The dyeing process of claim 1, in which the textile is composed of synthetic polyamide, aramid, wool, acrylic, cationic-dyeable polyester or cotton fibers or blends thereof.

9. A process for continuously dyeing a textile in open width using a nonionic, high-boiling organic liquid medium to diffuse a dye into the textile fibers and fix the dye to the fibers, the process comprising the successive steps of:

(1) applying to a textile selected from the group consisting of synthetic polyamide, aramid, wool, acrylic, cationic-dyeable polyester, cotton or blends thereof an aqueous solution of at least one ionic dye that is (a) water soluble and (b) substantially completely insoluble in the nonionic, high-boiling organic liquid medium;

(2) drying the textile of step (1) to reduce the moisture content to at most about 1% by weight;

(3) contacting the dried textile of step (2) with a nonionic, high-boiling organic liquid medium in which the ionic dye is substantially completely insoluble while the medium is maintained at a temperature from between about 325° F. to about 450° F. for a period of time sufficient to cause the dye to diffuse into the fibers of the textile and to fix the ionic dye to the fibers of the textile;

(4) removing the fabric from the liquid organic medium and recovering a substantially colorless, nonionic, high-boiling organic liquid medium; and thereafter (5) removing any organic liquid medium or unfixed dye remaining on the fabric.

10. The process of claim 9, in which the aqueous ionic dye solution is padded onto the fabric and the wet pick-up is thereafter adjusted to at most 50% by weight prior to drying.

11. The process of claim 9, in which the colorless, nonionic, high-boiling organic liquid medium recovered in step (4) is recycled and reused in step (3).

12. The process of claim 9, in which the textile is contacted with the nonionic, high-boiling organic liquid medium for a period of from 10 seconds up to about 120 seconds.

13. The process of claim 14, in which the textile is contacted with the nonionic, high-boiling organic liquid medium for a period of from 10 seconds up to about 60 seconds.

14. The process of claim 1, in which the dye is monosulfonic anionic dye.

15. A nylon fabric dyed according to the process of claim 1.

16. A nylon fabric dyed according to the process of claim 1.

17. A fabric composed of a blend of nylon and wool, dyed according to the process of claim 1.

18. The process of claim 1 in which the textile is acrylic or anionic-dyeable polyester and the dye is cationic.

19. The process of claim 1 in which the textile is synthetic polyamide, aramid, or wool and the dye is anionic.

20. The process of claim 1 in which the textile is cotton and the dye is fiber reactive.

21. The process of claim 11 in which the textile is acrylic or anionic-dyeable polyester and the dye is cationic.

22. The process of claim 11 in which the textile is synthetic polyamide, aramid, or wool and the dye is anionic.

23. The process of claim 1 in which the textile is cotton and the dye is fiber reactive.

* * * * *